US005422045A

United States Patent [19]

Notar et al.

[11] Patent Number: 5,422,045

[45] Date of Patent: Jun. 6, 1995

[54] APPARATUS FOR PRODUCING CARBONATED WATER

[75] Inventors: Robert Notar, Knittlingen; Udo Schwander, Karlsruhe; Gerd Hegel, Zaisenhausen; Raimond Gatter, Bretten, all of Germany

[73] Assignees: The Coca-Cola Company, Atlanta, Ga.; Bosch-Siemens Hausgerate GmbH, Munich, Germany

[21] Appl. No.: 233,972

[22] Filed: Apr. 28, 1994

[30] Foreign Application Priority Data

Aug. 28, 1992 [DE] Germany ..... 42 28 772.3

[51] Int. Cl.[6] ..... B01F 3/04

[52] U.S. Cl. ..... 261/140.1; 261/DIG. 7; 261/71

[58] Field of Search ..... 261/140.1, DIG. 7, 71

[56] References Cited

U.S. PATENT DOCUMENTS

| | | | |
|---|---|---|---|
| 2,235,357 | 3/1941 | Conklin . | |
| 2,514,463 | 7/1950 | Bayers, Jr. | 261/140.1 |
| 2,541,757 | 2/1951 | Grier . | |
| 2,665,559 | 1/1954 | Dexter | 261/140.1 |
| 2,750,076 | 6/1956 | Welty et al. | 261/140.1 |
| 3,259,273 | 7/1966 | Kromer | 261/140.1 |
| 3,752,452 | 8/1973 | Iannelli . | |
| 5,073,312 | 12/1991 | Burrows | 261/140.1 |
| 5,124,088 | 6/1992 | Stumphauzer | 261/DIG. 7 |
| 5,184,942 | 2/1993 | Deininger et al. | 261/DIG. 7 |

FOREIGN PATENT DOCUMENTS

| | | |
|---|---|---|
| 529557 | 6/1983 | Australia . |
| 4713343 | 2/1992 | European Pat. Off. . |

OTHER PUBLICATIONS

International Search Report and U.S. counterpart Patent 5,184,942 to EPO reference 471,343.

*Primary Examiner*—Tim Miles

[57] ABSTRACT

Apparatus which accelerates the cooling of the stored water cooled in the storage tank after a refilling operation so that it corresponds to the temperature that is normally reached after a relatively long water storage period. The apparatus includes a carbonator tank having at least one spray opening in the water feed line leading into the head-space region of the carbonator storage tank and where the spay opening is directed to the side walls of the tank in the vicinity of an ice bank formed on an upper inner wall surface thereof. An additional spray opening is oriented so that it points directly at the water surface and by a relatively simple valving arrangement both downward and/or lateral sprays can be implemented. The present invention also includes an arrangement where an adjustable spray guide element is located inside the storage tank in the immediate vicinity of a water feed opening so that a guiding of the sprayed water can be provided either toward the ice bank or directly toward the water surface inside the tank.

6 Claims, 1 Drawing Sheet

APPARATUS FOR PRODUCING CARBONATED WATER

This is a continuation of International Application PCT/EP93/02283, with an international filing date of Aug. 25, 1993.

BACKGROUND OF THE INVENTION

This invention relates to apparatus for mixing water with $CO_2$ gas to produce carbonated water in a storage tank and operates to cool its contents and to form an ice bank on the cooling pipes of a cooling circuit in the wall area of the storage tank, whose interior also includes the placement of a circulating pump, whereby $CO_2$ gas from the head area of the storage tank is mixed by rotation and/or circulation with the water inside the storage tank. Both fresh water and $CO_2$ gas are fed into the head area of the storage tank while carbonated water is removed from the base or bottom of the tank.

Apparatus which mixes water with $CO_2$ gas to produce carbonated water is well known and is used, for example, in post-mix beverage dispensing machines so that carbonated beverages can be prepared and dispensed on demand by mixing carbonated water with a suitable drink concentrate. The carbonated water mixed with the drink concentrate is produced directly in the storage tank by mixing water and $CO_2$ gas which is fed thereto and thereafter cooled for better carbonation, this being a requirement for a cool refreshing drink which is prepared for consumption as the need arises. The storage tank, commonly referred to as a carbonator, is fed fresh water of drinking quality either from the line of a water supply system or a pressurized storage tank. The fresh water, moreover, can be fed from the water supply system under pressure and can be enhanced, when desired, by the use of a pressure pump. Further, $CO_2$ gas is fed to the carbonator from a $CO_2$ gas storage tank by a pressure-reducing regulating valve so that a pressure of, for example, about 4 bars is built up in the carbonator.

In order to ensure sufficient carbonation of the fresh water, the carbonation process can be accomplished by or assisted by the use of a $CO_2$ circulating pump located in the carbonator. This type of pump draws $CO_2$ gas from the upper or head-space region of the carbonator filled with $CO_2$ gas and blends it with circulating water which is set in circular motion, such as by spinning.

As already noted, cooling of the carbonator is used, not only to improve the carbonation, but also as a requirement so that the finally prepared and dispensed drink exhibits a desired low and basically constant temperature. The cooling of the carbonator is achieved by a cooling system, which is adapted to form an ice bank of generally uniform thickness along the inner side walls of the carbonator as a result of the circulating water. Consequently, a cooling capacitor is produced, thus enhancing its "refrigerating capacity", thereby removing the need for a relatively powerful cooling system which would be necessary in a once-through cooling system.

Arrangements having a corresponding design as described above are well known, a typical example being shown and described in U.S. Pat. No. 5,184,942, Deininger et al, Feb. 9, 1993.

In the dispensing of a freshly prepared carbonated drink, a shutoff valve is typically opened in a line connected to the bottom of the carbonator, whereupon cooled carbonated water is fed therefrom to a concentrate mixing station. As a result, fresh water, which is relatively warmer than the carbonated water already stored in the storage tank, is fed by the feed line into the head-space region of the storage tank. Thus, immediately after the refilling process, the water in the carbonator tank is somewhat warmer than normal, particularly if a relatively large amount of water is exchanged when, for example, a large number of beverages are dispensed in a short sequence of time. The ice bank formed in the storage tank is used to specifically balance water temperature differences as quickly as possible by a partial melting of the ice bank. The time necessary for ice bank depletion is actually relatively short, but it is not short enough to make a noticeable temperature difference of the dispensed carbonated water in the case when infrequent dispensing occurs.

SUMMARY OF THE INVENTION

The principal object of this invention is, therefore, to provide apparatus which accelerates the cooling of the stored water cooled in the storage tank after a refilling operation so that it corresponds to the temperature that is normally reached after a relatively long water storage period.

Briefly, the subject invention comprises carbonator apparatus having at least one spray opening in the water feed line leading into the head-space region of a storage tank and where the spray opening is directed to the side walls of the tank in the vicinity of an ice bank formed on an upper inner wall surface thereof. Preferably, the spray opening is directed so that the spraying takes place above the water line where the ice bank is formed.

With such apparatus, the replenishing water fed into the storage tank via the spray opening(s) is immediately applied directly to the ice bank formed in the area of the side wall in a spray so that the incoming water is cooled down very quickly and efficiently. Since the water is sprayed laterally to the ice bank, it also sweeps the $CO_2$ gas-filled head space of the storage tank which is filled with $CO_2$ gas. Thus the carbonation process is also enhanced.

It is desirable that the spray opening(s) be designed to produce a generally circular lateral spreading of the input water on the ice except for the location of a water level sensor and an ice thickness sensor located inside the storage tank so as to maximize the effects of the ice build up of the ice bank.

When desirable, an additional spray opening can be oriented so that it points directly at the water surface and by a relatively simple valving arrangement both downward and/or lateral sprays can be implemented.

Also included is an embodiment wherein at least one adjustable spray guide element is located inside the storage tank in the immediate vicinity of a water feed opening, so that a guiding of the sprayed water can be provided toward the ice bank or, alternatively, directed toward the water surface. It should be noted that different combinations of these feed modes can be resorted to when needed.

BRIEF DESCRIPTION OF THE DRAWINGS

The details of the invention as set forth below will be more readily understood when considered together with the following drawings, wherein.

DETAILED DESCRIPTION OF THE INVENTION

Figure 1:
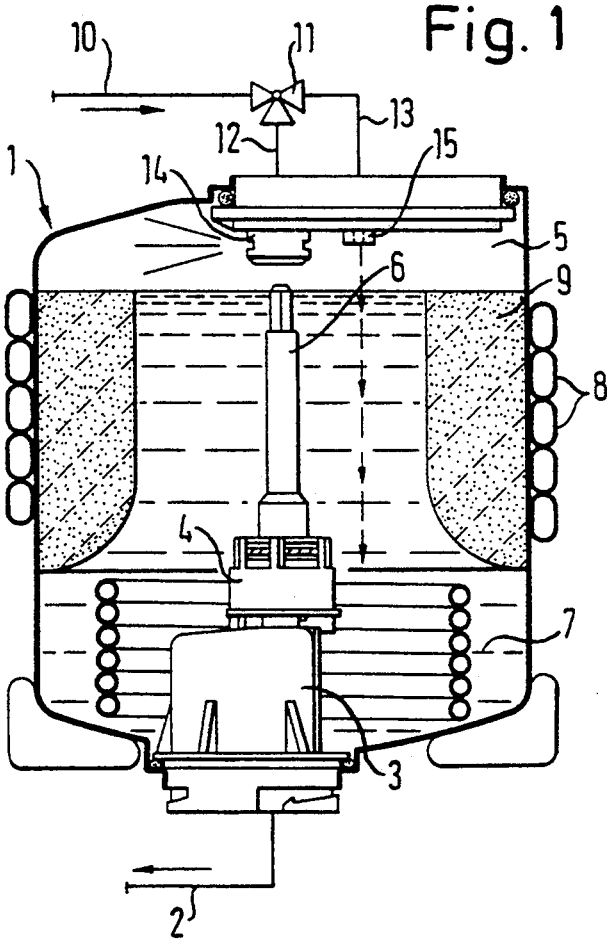
FIG. 1 is a schematic illustration of a storage tank having two separate spraying nozzles for respective lateral and vertical spraying of water fed into a carbonator storage tank.

Referring now to the drawings, a storage tank 1 as depicted in FIG. 1 is used in connection with apparatus, such as a carbonator, for preparing post-mix beverages by adding a suitable drink concentrate to carbonated water or simply to regular water when carbonation is not desired.

To prepare a post-mix beverage outside of the storage tank 1, a measured amount of cooled carbonated water is removed from the tank via an output line 2. Carbonation takes place and is at least assisted by a circulating pump 4 driven by an electric motor 3. The pump 4 draws the $CO_2$ gas present in the head-space region 5 of the storage tank 1 by a suction pipe 6 and mixes it with stored water 7 at the level of circulating pump 4. As a result, the $CO_2$ gas is dissolved and blended in with the water 7 to produce carbonated water. The set of coils inside the tank 1 surrounding the circulating pump 4 and the motor 3 is for cooling a separate source of fresh water for use as desired.

The cooling of the carbonated water takes place by a set of evaporator coils 8 of a cooling system, not shown, located on the outer surface of a thermally conducting tank wall. An ice bank 9 is formed on the interior wall surface of the storage tank 1 adjacent the evaporator coils 8. The thickness of the ice bank 9 is monitored in a well known manner by an ice sensor, also not shown, for controlling the refrigeration cycle and thus the refrigerating capacity of the apparatus.

The size of the ice bank 9 is controlled to produce a supply of carbonated water 7 which is cooled to a very constant temperature near the freezing point of water, without the need for relatively sensitive detection and measuring devices. $CO_2$ gas is supplied to the head-space region of the storage tank 1 in a well known manner and is set to provide an internal tank pressure of, typically 4 bars.

Fresh or still water is supplied to the storage tank 1 is by way of a feed pipe 10 coupled to a two-way valve 11 from which two feed water branches 12 and 13 connect to two separate injection nozzles 14 and 15 located in the head-space region 5 of the storage tank 1. The nozzle 14 is designed so that the water dispensed thereby, which can also be optionally augmented by a feed pump, not shown, is sprayed generally horizontally toward the side walls of storage tank 1 so that the water spray strikes the ice bank 9 in a generally horizontal pattern and is immediately cooled thereby. The upper portion of the ice bank 9 also acts to cool the $CO_2$ in the head-space region 5.

Water can also be fed by spray nozzle 15 into the storage tank 1 but is sprayed vertically downward directly on the water surface so that the input water mixes directly with the stored water 7. This briefly raises the water temperature until temperature equalization takes place due to presence of the ice bank 9. This process is further enhanced by the circulation of the water 7 by circulating pump 4.

Thus, freshly fed water which is sprayed directly on the ice bank 9 by means of the nozzle 14 only mixes with the water 7 after cooling by the ice bank 9; however, with the help of two-way valve 11, input water can be conveyed alternately or in equal or different amounts by the two spray nozzles 14 or 15.

Figure 2A:
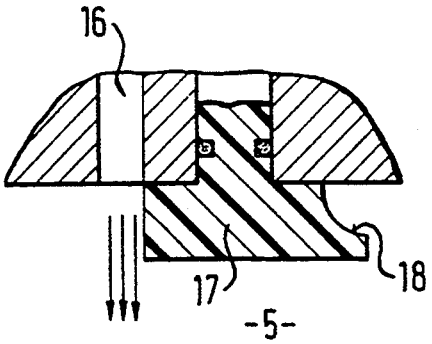
FIGS. 2*a* and 2*b* are central cross sectional views of a spray nozzle with a mechanically adjustable deflecting mechanism for alternately providing vertical and lateral water sprays.
Figure 2B:
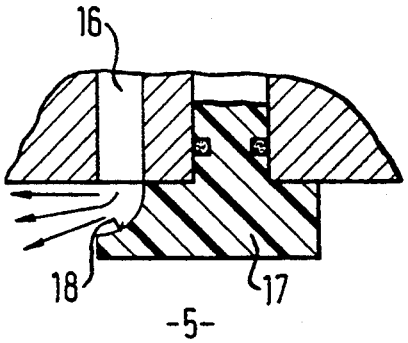

The embodiment depicted in FIGS. 2*a* and 2*b* represents an alternative to the spraying system shown in FIG. 1. There a water feed channel 16 coupled to the water line 10 is located in the upper portion of the head-space region 5 of the storage tank 1. A sliding disk 17 which can be rotated from the outside is additionally located in the immediate vicinity of the feed channel 16. When the disk 17 is in one rotary position, as shown in FIG. 2*a*, the input feed water is directed vertically downward to the water surface; however, when it is rotated 180° as shown in FIG. 2*b*, a deflecting surface 18 of the disk causes the incoming water to be sprayed laterally in a generally horizontal direction toward the side walls of storage tank 1 and the ice bank 9 formed thereat.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus for mixing fresh water with $CO_2$ gas to produce carbonated water, comprising:

a storage tank which operates to cool its contents;

means for feeding input feed water into the storage tank;

a cooling circuit including a set of cooling coils for forming an ice bank on an inner wall surface of the storage tank;

a circulating pump located inside the storage tank for mixing $CO_2$ gas in a head-space region of the storage tank with water in the storage tank and forming carbonated water thereby;

outlet means for removing carbonated water from a bottom portion of the storage tank; and spray generating means located in the head-space region of the storage tank and coupled to the water feeding means for selectively directing said input feed water into the storage tank both laterally in a horizontal direction and downwardly in a vertical direction inside the storage tank.

2. The apparatus according to claim 1 wherein said means for selectively directing said feed water into the storage tank comprises a water feed opening into the storage tank from said water feeding means and adjustable guide means located in said head-space region adjacent said water feed opening for selectively permitting unobstructed flow of water directly downward to the surface of the water in the storage tank or directing the flow of water laterally toward the ice bank on the inner side wall of the storage tank.

3. The apparatus according to claim 1, wherein the spray generating means directs water fed into the storage tank above the water line of the water in the tank.

4. The apparatus according to claim 1 wherein said spray generating means comprises a first nozzle for forming a generally horizontal spray and second nozzle for forming a generally vertical spray.

5. The apparatus according to claim 4 and further comprising valve means in said means for feeding input feed water into the storage tank for selectively coupling said input feed water to said first and second nozzles.

6. The apparatus according to claim 4 wherein said first nozzle forms a generally lateral spray with at least one region devoid of spray at the location of sensors located in said storage tank for detecting water level and ice bank thickness.

* * * * *